US006769406B2

(12) United States Patent
Ohta et al.

(10) Patent No.: US 6,769,406 B2
(45) Date of Patent: Aug. 3, 2004

(54) FUEL INJECTION APPARATUS

(75) Inventors: Hiroshi Ohta, Oyama (JP); Takanobu Akutsu, Oyama (JP); Takashi Sakasai, Oyama (JP); Shuki Akushichi, Oyama (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 10/405,841

(22) Filed: Apr. 2, 2003

(65) Prior Publication Data

US 2003/0200956 A1 Oct. 30, 2003

(30) Foreign Application Priority Data

Apr. 26, 2002 (JP) ..... 2002-127032

(51) Int. Cl.[7] ..... F02M 41/00
(52) U.S. Cl. ..... 123/458; 123/447; 123/456
(58) Field of Search ..... 123/458, 447, 123/446, 445, 457

(56) References Cited

U.S. PATENT DOCUMENTS 5,355,856 A * 10/1994 Paul et al. ..... 123/446

* cited by examiner

*Primary Examiner*—Bibhu Mohanty
(74) *Attorney, Agent, or Firm*—Frishauf, Holtz, Goodman & Chick, P.C.

(57) ABSTRACT

In a fuel injection apparatus 1, a fuel injection rate from which is controlled by a fuel pressure, a branch pipe 11 comprising a tubular member with the tip end closed is provided between a second pressure control valve 9 and a second pressure sensor 10. The branch pipe 11 extends in a direction along a flow direction of the fuel just before the branch pipe 11, and has a capacity not less than one fifth of that of a fuel flow path 22 between the second pressure control valve 9 and a fuel chamber 17. When a pressure difference in the pressure control valve 9 becomes larger and vibration of the fuel pressure is generated, the branch pipe 11 absorbs and reduces the vibration. As the vibration of the fuel pressure is reduced, a stable fuel injection rate is realized.

5 Claims, 2 Drawing Sheets

FUEL INJECTION APPARATUS

BACKGROUND OF THE INVENTION

1. Field of the Invention

The present invention relates to a fuel injection apparatus for injecting a fuel, for instance, to an internal combustion engine, and more specifically to a fuel injection apparatus for controlling a fuel injection rate by a fuel pressure.

2. Description of Related Art

Conventionally, as a fuel injection apparatus for injecting a fuel, for instance, to an engine, there has been one equipped with a fuel injector capable of controlling a fuel injection rate by making use of the fuel pressure. This fuel injector has two fuel chambers provided at both sides of a plunger provided inside the fuel injector, and timing for injecting the fuel is adjusted by making use of the fuel pressure in one of the fuel chambers, and the fuel injection rate is adjusted by making use of the fuel pressure in another fuel chamber. Fuel feed to these two fuel chambers is performed from a fuel tank by operating a common fuel pump, and a fuel conduit is branched in the downstream from the fuel pump to a timing rail connected to the fuel chamber for controlling the timing for fuel injection and a fuel rail connected to the chamber for controlling the fuel injection rate. Each of the timing rail and the fuel rail has a pressure control valve, and the fuel is fed to each of the fuel chambers by adjusting a pressure of the fuel from the fuel pump with this pressure control valve.

In the fuel injector as described above, a higher fuel pressure as compared to that in the fuel rail is required in the timing rail, so that the common fuel pump generally feed a fuel according to the higher pressure required in the timing rail. Therefore, in the fuel rail, it is necessary to substantially reduce the fuel pressure in the fuel rail with the pressure control valve, and a difference between pressures before and behind the pressure control valve becomes large. When this pressure difference becomes larger, air bubbles are generated in the pressure control valve, and sometimes the pressure control disadvantageously vibrates. When this phenomenon occurs, fluctuation occurs in the fuel pressure to cause variation in the fuel injection rate, which in turn cause fluctuation in a revolution speed of the engine. Further vibration in the fuel pressure may occur in association with the vibration of the fuel pump.

SUMMARY OF THE INVENTION

A main object of the present invention is to provide a fuel injection apparatus in which vibration of a fuel pressure can be reduced to feed a fuel at a stable fuel injection rate. To achieve this purpose, the fuel injection apparatus according to the present invention has a unit for absorbing the pressure vibration provided therein. The configuration is described in detail below.

The fuel injection apparatus according to the present invention comprises a fuel injector having a fuel chamber with the fuel injection rate therefrom controlled by the fuel pressure having a fuel chamber for temporally storing therein a fuel to be injected; a fuel tank for storing therein a fuel; a fuel pump for pumping the fuel from the fuel tank and sending the fuel to the fuel chamber; a discharge line provided between the fuel pump and the fuel chamber; a pressure control valve provided in the discharge line for controlling a pressure of the fuel to be sent to the fuel chamber; and a pressure damping chamber provided between the pressure control valve and the fuel chamber.

In this configuration, as the pressure damping chamber is provided between the pressure control valve and the fuel chamber, vibration of the fuel pressure generated in the pressure control valve is absorbed and reduced in the pressure damping chamber to insure the stable fuel injection rate. For instance, when this fuel injection apparatus is used in an engine driving a generator, fluctuation in a revolution speed of the engine decreases in association with stabilization of the fuel injection rate, so that also a frequency of the generated electricity stabilizes. Because of this feature, when the generator is used concurrently as a power source for business use, it is easy to synchronize the frequency to that of commercial power.

In the fuel injection apparatus according to the present invention, the pressure damping chamber is preferably provided near the pressure control valve.

In this configuration, as the pressure damping chamber is provided near the pressure control valve in which vibration of the fuel pressure is generated, the vibration is effectively reduced, which enables a more stable fuel injection rate.

In the fuel injection apparatus according to the present invention, the pressure damping chamber is preferably a branch pipe branched from the discharge line with the top edge closed.

In this configuration, as the pressure damping chamber comprises a branch pipe, if the branch pipe is manufactured, for instance, with a tubular member, the branch pipe can easily be manufactured and the price is cheap. Further the branch pipe has a slender form, so that the branch pipe can easily be installed even in a narrow engine room, which insure a higher degree of freedom in designing. Because of this feature, it is also easy to additionally install the branch pipe in an engine already installed.

In the fuel injection apparatus according to the present invention, the branch pipe preferably extends in a direction along a flow of the fuel just before the branch pipe.

In this configuration, as the branch pipe extends along the direction of the fuel flow, vibration of the fuel pressure is easily delivered to the branch pipe, so that the vibration is more effectively reduced.

In the fuel injection apparatus according to the present invention, capacity of the pressure damping chamber is preferably not less than one fifth of that of the discharge line between the pressure control valve and the fuel injection chamber.

In this configuration, as a capacity of the pressure damping chamber is set to a value just suited to the purpose, vibration in the fuel pressure is fully communicated to and absorbed into inside of the branch pipe. It is to be noted that, if the capacity of the pressure damping chamber is less than one fifth of that of the discharge line between the pressure control valve and the fuel chamber, the vibration of the fuel pressure generated in the pressure control valve is not fully communicated to the branch pipe, and the vibration can not effectively be reduced.

DETAILED DESCRIPTION OF PREFERRED EMBODIMENT(S)

One embodiment of the present invention is described in detail with reference to the drawings.

Figure 1:
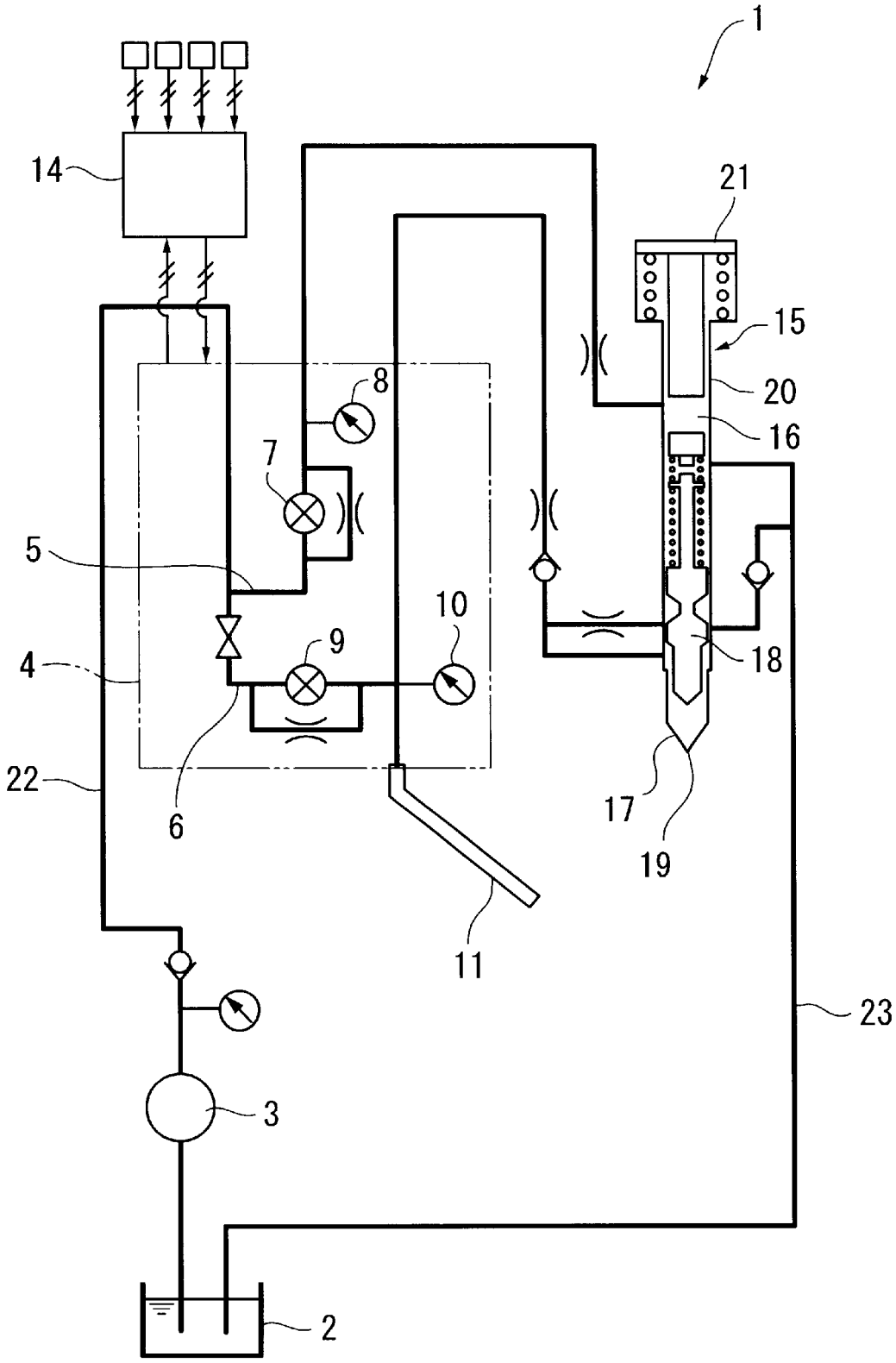
FIG. 1 is a general block diagram showing an fuel injection apparatus according to one embodiment of the present invention as a whole.

FIG. 1 is a general block diagram showing a fuel injection apparatus 1 according to the embodiment as a whole. In this figure, the fuel injection apparatus 1 comprises a fuel tank 2 for storing a fuel therein; a fuel injector 15 for injecting the fuel to an engine not shown in the figure; a fuel pump 3 for pumping up the fuel from the fuel tank 2 and feeding the fuel to the fuel injector 15; a fuel flow path 22 provided between this fuel pump 3 and the fuel injector 15; and a control valve unit 4 provided in the fuel flow path 22 for controlling a fuel pressure from the fuel pump 3.

A fuel injection rate and timing for injecting the fuel from the fuel injector 15 are controlled according to the fuel pressure, and an injection nozzle 19 for injecting the fuel is provided at a tip of a cylindrical body 20 thereof. In this embodiment, the injection nozzle 19 is formed by providing small holes at a tip of the cylindrical body, and the injection nozzle is the so-called open nozzle in which opening of each hole is always open irrespective of whether injection is being performed or not. Further an external plunger 21 driven from the outside by a cum not shown herein is back and forth movably provided inside the cylindrical body 20 on a base thereof. An internal plunger 18 having a substantially cylindrical form is slidably provided inside the cylindrical body 20, and two spaces separated by this internal plunger 18 from each other are provided therein. Of these two spaces, the space in which the external plunger 21 is provided is a timing-control fuel chamber 16 for controlling the timing for injecting the fuel, and in the space in which the injection nozzle 19 is formed is a jet fuel injection chamber 17 for controlling a fuel injection rate.

A return flow path 23 connected from the timing control fuel chamber 16 as well as from the fuel chamber 17 to the fuel tank 2 is provided in the fuel injector 15.

The fuel pump 3 pumps the fuel from the fuel tank at a relatively high pressure to feed the fuel having an appropriate pressure to both the timing control fuel chamber 16 and the fuel injection fuel chamber 17. As the fuel pump 3, for instance, a gear pump may be used.

In the control valve unit 4, the fuel flow path 22 is branched to two flow paths. Of these two flow paths, one constitutes a portion of the timing rail 5 connected to the timing control fuel chamber 16, and another constitutes a portion of the fuel rail 6 as a discharge line connected to the fuel chamber 17.

The timing rail 5 comprises, in the control valve unit 4, a first pressure control valve 7 for controlling a fuel pressure to the timing control fuel chamber 16 and a first pressure sensor 8 for detecting the controlled fuel pressure. The fuel rail 6 comprises, in the control valve unit 4, a second pressure control valve 9 for controlling a fuel pressure to the fuel chamber 17, and a second pressure sensor 10 for detecting the controlled fuel pressure. The first pressure sensor 8 and the second pressure sensor 10 are electrically connected to an engine controller 14 for controlling operations of the engine, and the fuel pressures to the timing fuel chamber 16 and to the fuel chamber 17 are detected by the first and second pressure sensors 8, 10 and are sent as signals to the engine controller 14. Further also the first and second pressure control valves 7, 9 are electrically connected to the engine controller 14, so that an instruction for setting a fuel pressure can be sent thereto from the engine controller 14.

Figure 2:
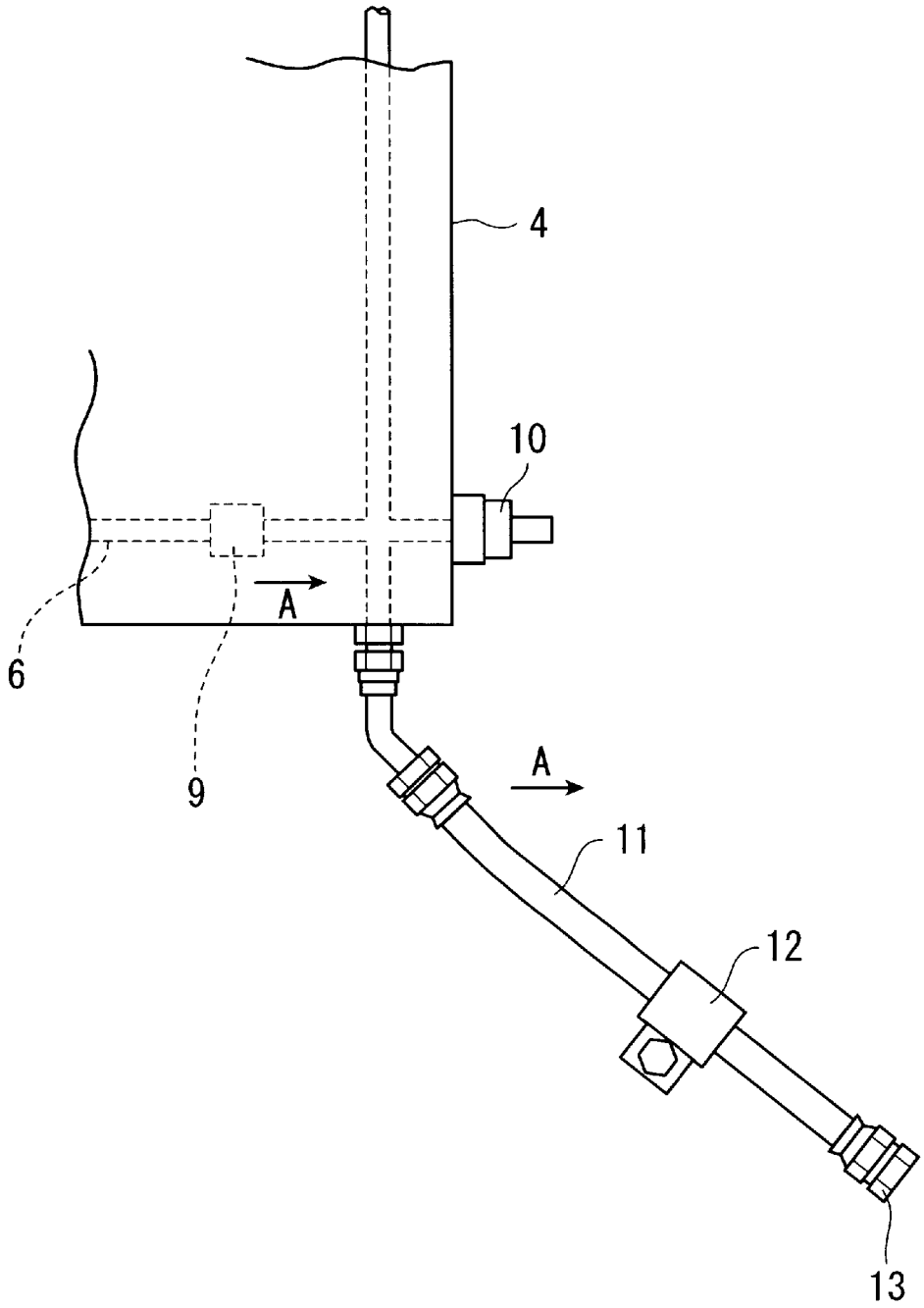
FIG. 2 is an enlarged view showing a branch pipe according to the present invention.

A branch pipe 11 as a fuel pressure attenuating chamber is provided between the second pressure control valve 9 and the second pressure sensor 10 and just behind the second pressure control valve 9. As shown in FIG. 2, the branch pipe 11 comprises a tubular member made of ethylene polyfluoride or other materials, and the tip is sealed with a sealing member 13. The branch 11 extends in a direction along the flow direction of the fuel flow A just before the branch pipe 11, and is fixed to the engine with a hooking member 12. Parameters of the branch pipe 11 such as the inner diameter and the length can be set to appropriate values taking into considerations a range of the fuel pressure controlled by the second pressure control valve 9 and dimensions of the used fuel flow path 22, and in this embodiment, a capacity of the branch pipe is set to a value not less than one fifth of the capacity of the fuel flow path 22 in the fuel rail 6 from the second pressure control valve 9 to the fuel chamber 17.

The fuel injection apparatus having the configuration as described above operates as described below.

The fuel pump 3 pumps up the fuel from the fuel tank 2, and feeds the fuel at a relatively high pressure to the control valve unit 4. The fuel fed to the control valve unit 4 is divided to that flowing through the timing rail 5 and that flowing through the fuel rail 6, and a fuel pressure of the fuel is adjusted to the first or second pressure control valve 7 or 9 to an prespecified value. The first and second pressure sensor 8, 10 detect fuel pressures of the fuels controlled by the first and second pressure control valves 7, 9 respectively and transmits signals indicating the detected fuel pressures to the engine controller 14. The engine controller 14 detects the operating state of the engine by detecting the fuel injection timing and the fuel injection rate, namely the engine's duty according to the signals.

The fuel with the controlled pressure is sent from the timing rail 5 to inside of the timing control fuel chamber 16, or from the fuel rail 6 to inside of the fuel chamber 17. When the external plunger 21 is pressed by the cum, the internal plunger 21 blocks up the fuel inlet path in the timing rail 5, so that the fuel inside the timing control fuel chamber 16 forms a fluid link. In association with the descending movement of the external plunger 21, the internal plunger 18 pushed out the fuel inside the fuel chamber 17 from the injection nozzle 19, so that the fuel is injected to inside the engine. When the internal plunger 18 descends and the timing control fuel chamber 16 is communicated to the return flow path 23. the fluid link is released, and the fuel inside the timing control fuel chamber 16 flows to the return flow path 23, so that the internal plunger 18 goes up to terminate the operation for injecting the fuel.

When an instruction for setting a fuel injection rate or the timing for injecting the fuel is transmitted from the engine control 14, the first pressure control valve 7 and the second pressure control valve 9 receive the instruction. The first pressure control valve 7 regulates the timing for injecting the fuel by adjusting a fuel pressure to the timing control fuel chamber 16, and the second pressure control valve 9 regulates a fuel injection rate by adjusting a fuel pressure to the fuel chamber 17.

The fuel pump 3 feeds the fuel to each of the timing rail 5 and the fuel rail 6 at a required fuel pressure, and as a fuel pressure inside the fuel chamber 17 is set to a value substantially lower than that inside the timing control fuel chamber 16, the fuel pressure is required to be substantially reduced in the second pressure control valve 9 in the fuel rail 6. In this step, air bubbles are generated in the second pressure control valve 9 due to the pressure difference, and sometimes vibration of the fuel pressure may be generated therein. In this case, the branch pipe 11 provided just behind the pressure control valve 9 absorbs the vibration of the fuel pressure, and because of this feature, the vibration of the fuel pressure in the downstream from the pressure control valve 9 is reduced.

With the embodiment described above, the following effects are provided.

(1) Namely, the branch pipe 11 is provided between the second pressure control valve 9 and the fuel chamber 17, so that vibration of the fuel pressure generated in the second pressure control valve 9 can be reduced in this branch pipe 11. Therefore, the fuel injection rate is stabilized, and fluctuation of a revolution speed of a diesel engine can be reduced. For instance, when the engine equipped with the fuel injection apparatus according to this embodiment is used in a generator, the engine's revolution speed is stabilized, so that non-uniformity in a frequency of generated power can be reduced. Especially, when this generator is used together with a commercial power source, the frequency of generated power can easily be synchronized with the commercial power, which is advantageous.

(2) As the second branch pipe 11 is provided just behind the second pressure control valve 9, so that vibration of the fuel pressure generated in the second pressure control valve 9 is easily communicated to the branch pipe 11, and the branch pipe 11 absorbs the vibration, which is advantageous in reducing fluctuation in the fuel injection rate. Also the branch pipe 11 is provided in the upstream side from the second pressure sensor 10, so that the pressure sensor 10 is not affected the acute vibration of the fuel pressure and is hardly broken, so that the it can be used for a long period of time.

(3) The branch pipe 11 extends in a direction along the flow direction of the fuel just before the branch pipe 11, so that the vibration of the fuel pressure can be communicated more effectively to the branch pipe 11, and therefore the vibration can be reduced more effectively.

(4) As a capacity of the branch pipe 11 is not less than one fifth of that of the fuel flow path 22 in the fuel rail 6 provided between the second pressure control valve 9 and the fuel chamber 17, an appropriate capacity is provided, and the vibration of the fuel pressure can effectively be reduced.

(5) The branch pipe 11 comprises a tubular member with one edge thereof closed, so that procurement of the member is easy and the branch pipe 11 can be manufactured with a low cost. Further the branch pipe 11 can be formed into a slender form, so that an excessively large space is not required for its installation even in an engine, which is advantageous in improvement of a freedom degree in designing. Because of this feature, a space for its installation can easily be acquired even in an engine already installed, which is advantageous in enlargement of the application range.

The present invention is not limited to the embodiment described above, and changes, modifications or the like in a range in which the object of the present invention can be achieved is included in the range of the present invention.

For instance, in the embodiment described above, the pressure damping chamber is the branch pipe 11, but the present invention is not limited to this configuration, and for instance, a bag-formed vessel may be used for the pressure damping chamber, and also the form may be modified taking into considerations such factors as a layout of the engine room or an application range of the engine.

In the above description, the timing for injecting the fuel is controlled by the fuel pressure in the timing control fuel chamber 16, and the present invention is not limited to this configuration, and the timing may be controlled mechanically or electrically.

In the embodiment described above, the branch pipe 11 is provided just behind the second pressure control valve 9, but the present invention is not limited to this configuration, and when the branch pipe 11 is provided in the fuel rail 6 between the second pressure control valve 9 and the fuel chamber 17, the vibration of the fuel pressure generated in the second pressure control valve 9 can be absorbed. Although the branch pipe 11 extends in a direction along the flow direction A of the fuel just before the branch pipe 11, but even if the branch pipe 11 extends in the direction reverse to the flow direction, the object of the present invention can be achieved. However, vibration of the fuel pressure can be reduced more efficiently when the branch pipe 11 extends in a direction along the flow direction A of the fuel.

In the embodiment described above, a capacity of the branch pipe 11 is not more than one fifth of that of the fuel flow path 22 in the fuel rail 6 between the second pressure control valve 9 and the fuel chamber 17, but even if the capacity is smaller than one fifth of the capacity of the fuel flow path 22, the object of the present invention can be achieved. However, when the capacity is not less than one fifth of that of the fuel flow path 22, vibration of the fuel pressure can be reduced more efficiently.

The best configuration, method or the like for carrying out the present invention were disclosed above, but the present invention is not limited to those described above. In other words, the present invention was illustrated and described with reference to the specific embodiment thereof, but various modifications can be made to the embodiment of the present invention described above in the form, material, quantity, and other details of the configuration of the present invention by those skilled in the art within the scope of the technical concept or within the targeted range of the present invention.

Therefore, the descriptions concerning the forms, materials or the like disclosed above are only illustrative, and are not intended to limit the present invention in any manner, and descriptions with member names removing a portion or all of the limitations concerning the forms, materials, and other parameters are included within the scope of the present invention.

What is claimed is:

1. An fuel injection apparatus comprising:

a fuel injector with the fuel injection rate therefrom controlled by a fuel pressure and having a fuel chamber for temporally storing therein a fuel to be injected;

a fuel tank for storing therein the fuel;

a fuel pump for pumping up the fuel from said fuel tank and feeding the fuel to said fuel chamber;

a discharge line provided between said fuel pump and said fuel chamber;

a pressure control valve provided in said discharge line for controlling a pressure of the fuel fed to said fuel chamber; and a pressure damping chamber provided between said pressure control valve and said fuel chamber.

2. The fuel injection apparatus according to claim 1, wherein said pressure damping chamber is provided near said pressure control valve.

3. The fuel injection apparatus according to claim 1, wherein said pressure damping chamber is a branch pipe branched from said discharge line with the tip end closed.

4. The fuel injection apparatus according to claim 3, wherein said branch pipe extends in a direction along the flow direction of the fuel just before said branch pipe.

5. The fuel injection apparatus according to claim 1, wherein a capacity of said pressure damping chamber is not less than one fifth of that of the discharge line between said pressure control chamber and said fuel chamber.

* * * * *